US008032051B2

(12) United States Patent
Takiguchi et al.

(10) Patent No.: US 8,032,051 B2
(45) Date of Patent: Oct. 4, 2011

(54) BELT CARRYING DEVICE, INTERMEDIATE TRANSFER DEVICE, AND IMAGE FORMING APPARATUS

(75) Inventors: Toshiki Takiguchi, Yamatokoriyama (JP); Hideshi Izumi, Ikoma (JP); Takahiko Yoshida, Nara (JP); Hiroyuki Murai, Yamatokoriyama (JP)

(73) Assignee: Sharp Kabushiki Kaisha, Osaka-Shi, Osaka (JP)

( * ) Notice: Subject to any disclaimer, the term of this patent is extended or adjusted under 35 U.S.C. 154(b) by 355 days.

(21) Appl. No.: 12/369,253

(22) Filed: Feb. 11, 2009

(65) Prior Publication Data

US 2009/0208241 A1 Aug. 20, 2009

(30) Foreign Application Priority Data

Feb. 20, 2008 (JP) ..... 2008-039170

(51) Int. Cl.
*G03G 15/16* (2006.01)
*G03G 15/01* (2006.01)

(52) U.S. Cl. ..... 399/101; 399/302

(58) Field of Classification Search ..... 399/101, 399/302

See application file for complete search history.

(56) References Cited

U.S. PATENT DOCUMENTS 5,873,016 A 2/1999 Kurokawa et al.

FOREIGN PATENT DOCUMENTS

| | | |
|---|---|---|
| JP | 5-204199 A | 8/1993 |
| JP | 09-301565 | 11/1997 |
| JP | 2000-112259 | 4/2000 |
| JP | 2004-046199 | 2/2004 |
| JP | 2006-251131 A | 9/2006 |
| JP | 2007-003933 | 1/2007 |

*Primary Examiner* — David Gray
*Assistant Examiner* — Erika J Villaluna
(74) *Attorney, Agent, or Firm* — Nixon & Vanderhye, P.C.

(57) ABSTRACT

A belt carrying device includes supporting rollers, an endless belt supported by the supporting rollers, and guiding members provided on the endless belt. The endless belt is rotated by rotation of the supporting rollers. An outer peripheral surface of the endless belt is in contact with a cleaning member. The guiding members are provided on those projecting areas of the endless belt, which project in an axial direction of the supporting rollers from both end surfaces of the supporting roller. A guiding member suppresses meandering of the endless belt by coming into contact with an end surface of the supporting roller. Formed on the end, surfaces of at least one of the supporting rollers are projecting sections and groove sections, which are rotated around a rotation axis of the at least one of the supporting rollers in response to rotation of the at least one of the supporting rollers.

7 Claims, 8 Drawing Sheets

BELT CARRYING DEVICE, INTERMEDIATE TRANSFER DEVICE, AND IMAGE FORMING APPARATUS

This Nonprovisional application claims priority under 35 U.S.C. §119(a) on Patent Application No. 039170/2008 filed in Japan on Feb. 20, 2008, the entire contents of which are hereby incorporated by reference.

FIELD OF THE TECHNOLOGY

The technology relates to (i) a belt carrying device including a plurality of rollers and an endless belt supported by the plurality of rollers, (ii) an intermediate transfer device including the belt carrying device, and (iii) an electrophotographic image forming apparatus including the intermediate transfer device.

BACKGROUND OF THE TECHNOLOGY

There has been known a belt carrying device including an endless belt supported by a plurality of supporting rollers. In the belt carrying device, at least one of the plurality of supporting rollers serves as a driving roller and is rotated. This gives the endless belt a driving force, so that the endless belt is driven and rotated.

Such a belt carrying device is used as a paper carrying unit and/or an intermediate transfer device in an electrophotographic image forming apparatus. The paper carrying unit is a unit for carrying a sheet placed on an endless belt. The intermediate transfer device is a unit that (i) carries out a primary transfer in which a toner image formed on an image carrier such as a photoreceptor onto a belt (an intermediate transfer belt), (ii) carries the toner image thus transferred onto the belt to a predetermined position, and then (iii) carries out a secondary transfer in which the toner image is transferred onto a sheet.

It is preferable that the plurality of supporting rollers provided in the belt carrying device are positioned so as to be completely in parallel with each other. However, it cannot be denied that some errors can be caused in positioning of the plurality of supporting rollers. The endless belt always has some manufacturing errors. It is difficult to manufacture an endless belt having no deviation in peripheral length in a width direction. A meandering phenomenon (belt training deviation) is most likely to occur in which the endless belt, while it is rotating, moves to one side in an axial direction of the supporting rollers, due to the error caused in positioning of the plurality of supporting rollers and/or the deviation in peripheral length of the endless belt.

In view of this, each of Patent Documents 1 and 2 discloses an intermediate transfer device (a belt carrying device) including an endless belt having meandering preventing guides in the vicinity of both ends in a width direction on an inner peripheral side of the endless belt, respectively. Each of the meandering preventing guides (guides for preventing the endless belt from moving to one side) has a rib shape and is provided so as to extend in a rotation direction of the endless belt. In this kind of intermediate transfer device, a meandering preventing guide provided on the endless belt and an end surface (bottom surface) of a supporting roller come into contact with each other. This causes the meandering phenomenon to be suppressed. This makes it possible to prevent the endless belt from coming off the supporting roller even in case of progress in the meandering. The meandering preventing guides also serve as guiding members used when a belt member is attached to the plurality of supporting rollers. As such, the meandering preventing guides make it possible to prevent the belt member from greatly moving to one end in the axial direction of the plurality of supporting rollers when the belt member is put on the plurality of supporting rollers.

The following describes an intermediate transfer device to be provided in an image forming apparatus, with reference to FIG. 7. As illustrated in FIG. 7, an intermediate transfer device 200 includes a supporting roller 201, a shaft 202 for rotatably supporting the supporting roller 201, and an intermediate transfer belt 203, which is an endless belt and is supported by the supporting roller 201.

The supporting roller 201 includes a roller body 201*a* having a cylindrical shape, and covers (collars) 201*b*. The covers 201*b* are fitted to one and the other ends of the roller body 201*a*, respectively, in an axial direction of the roller body 201*a*. The intermediate transfer device 200 actually includes a plurality of supporting rollers 201 although FIG. 7 illustrates only one of the plurality of supporting rollers 201.

As illustrated in FIG. 7, the intermediate transfer belt 203 is designed so that the intermediate transfer belt 203 has a width (i.e., a length of the intermediate transfer belt 203 in the axial direction of the supporting roller 201) longer than a length of the supporting roller 201 (i.e., a length of the supporting roller 201 in the axial direction). As illustrated in FIG. 7, the intermediate transfer belt 203 is positioned so as to project from both ends of the supporting roller 201 in the axial direction. Parts of the intermediate transfer belt 203, which project from the both ends of the supporting roller 201 in the axial direction of the supporting roller 201, are referred to as projecting areas 203*a*. Meandering preventing guides 205 are fixed on inner peripheral surfaces of the intermediate transfer belt 203 in the projecting areas 203*a*, respectively. In a case where meandering is caused in the intermediate transfer device 200 illustrated in FIG. 7, a cover 201*b* and a meandering preventing guide 205 come into contact with each other on an end surface of the supporting roller 201, respectively. This causes the meandering to be suppressed.

As illustrated in FIG. 7, the image forming apparatus includes a cleaning blade 204 which is in contact with a surface on an outer peripheral side of the intermediate transfer belt 203. The cleaning blade 204 is a member for cleaning an outer surface of the intermediate transfer belt 203, by scraping off waste such as paper dust, dirt, dust, and/or toner that has not been subjected to the secondary transfer onto a sheet but remains on the intermediate transfer belt 203.

[Patent Document 1]

Japanese Unexamined Patent Publication 2000-112259 (Tokukai 2000-112259, date of publication: Apr. 21, 2000)

[Patent Document 2]

Japanese Unexamined Patent Publication 2007-003933 (Tokukai 2007-003933, date of publication: Jan. 11, 2007)

Since the projecting areas 203*a* are not directly supported by the supporting roller 201, the projecting areas 203*a* can have some deflection. Furthermore, as illustrated in FIG. 9, the deflection causes the projecting areas 203*a* of the intermediate transfer belt 203 to bend somewhat. This gives rise to a situation in which the projecting areas 203*a* of the intermediate transfer belt 203 is away from the cleaning blade 204. Such a situation can be caused independently of a material of which the intermediate transfer belt 203 is made. In particular, such a situation is significantly caused in a case where the intermediate transfer belt 203 is made of a low shrinkage resin such as polyimide, polyamide-imide, or polycarbonate.

When such a situation is caused, toner remaining on the projecting area 203*a* cannot be scraped off by the cleaning blade 204 but is allowed to pass through as it is. This is because the projecting areas 203*a* of the intermediate transfer belt 203 are away from the cleaning blade 204. That is, the remaining toner passes through the space between the cleaning blade 204 and the intermediate transfer belt 203. As illustrated in FIG. 8, This causes the remaining toner to be accumulated in the vicinity of the projecting area 203*a* of the intermediate transfer belt 203. Furthermore, the remaining toner thus accumulated linearly extends in a carrying direction of the intermediate transfer belt 203, thereby forming a toner stain. This ultimately causes inadequate cleaning.

SUMMARY OF THE TECHNOLOGY

An object of the technology is to suppress inadequate cleaning to be caused in a belt carrying device, in which a cleaning member that is in contact with a surface of a belt cleans the surface of the belt.

A belt carrying device includes: a plurality of supporting rollers; an endless belt, supported by the plurality of supporting rollers, which is rotated in response to rotations of the plurality of supporting rollers; and guiding members which are provided in projecting areas of the endless belt which project, in an axial direction of the plurality of supporting rollers, from end surfaces of the plurality of supporting rollers, respectively, said guiding members coming into contact with the end surfaces, respectively, so that meandering of the endless belt is suppressed, in said belt carrying device, an outer peripheral surface of the endless belt being cleaned by a cleaning member which is in contact with the outer peripheral surface of the endless belt, at least one of a projecting section and a groove section (i) being provided on end surfaces of at least one of the plurality of supporting rollers, and (ii) rotating around an axis of said at least one of the plurality of supporting rollers in response to rotation of said at least one of the plurality of supporting rollers.

While the end surface of the supporting roller and the guiding member are in contact with each other, according to the arrangement of the technology, the guiding member is shaken by slopes or steps of the projecting section and the groove section, which projecting sections and the groove sections are formed on the end surface. Accordingly shaken is that projecting area of the endless belt on which the guiding member is provided. The shakes of the projecting area moves a cleaning target adhered onto the outer peripheral surface of the endless belt in the projecting area.

Thus, it is possible to move to a position at which the outer peripheral surface of the endless belt and the cleaning member maintain contact with each other the cleaning target adhered onto the outer peripheral surface of the endless belt in the projecting area, even if there is a space between the outer peripheral surface of the endless belt in the projecting area and the cleaning member. This makes it possible to suppress the cleaning target from accumulating at one and the same position on the endless belt, and to thereby suppress inadequate cleaning.

Additional objects, features, and strengths of the technology will be made clear by the description below. Further, the advantages of the technology will be evident from the following explanation in reference to the drawings.

BRIEF DESCRIPTION OF THE DRAWINGS

FIG. 4(*b*) is a development view illustrating a circumferential surface in the vicinity of one of end surfaces (bottom surfaces) of a driven roller provided in the intermediate transfer device.

FIG. 5(*b*) is a view illustrating a state after the toner on the intermediate transfer belt is moved in the intermediate transfer device.

DESCRIPTION OF THE EMBODIMENTS

Figure 2:
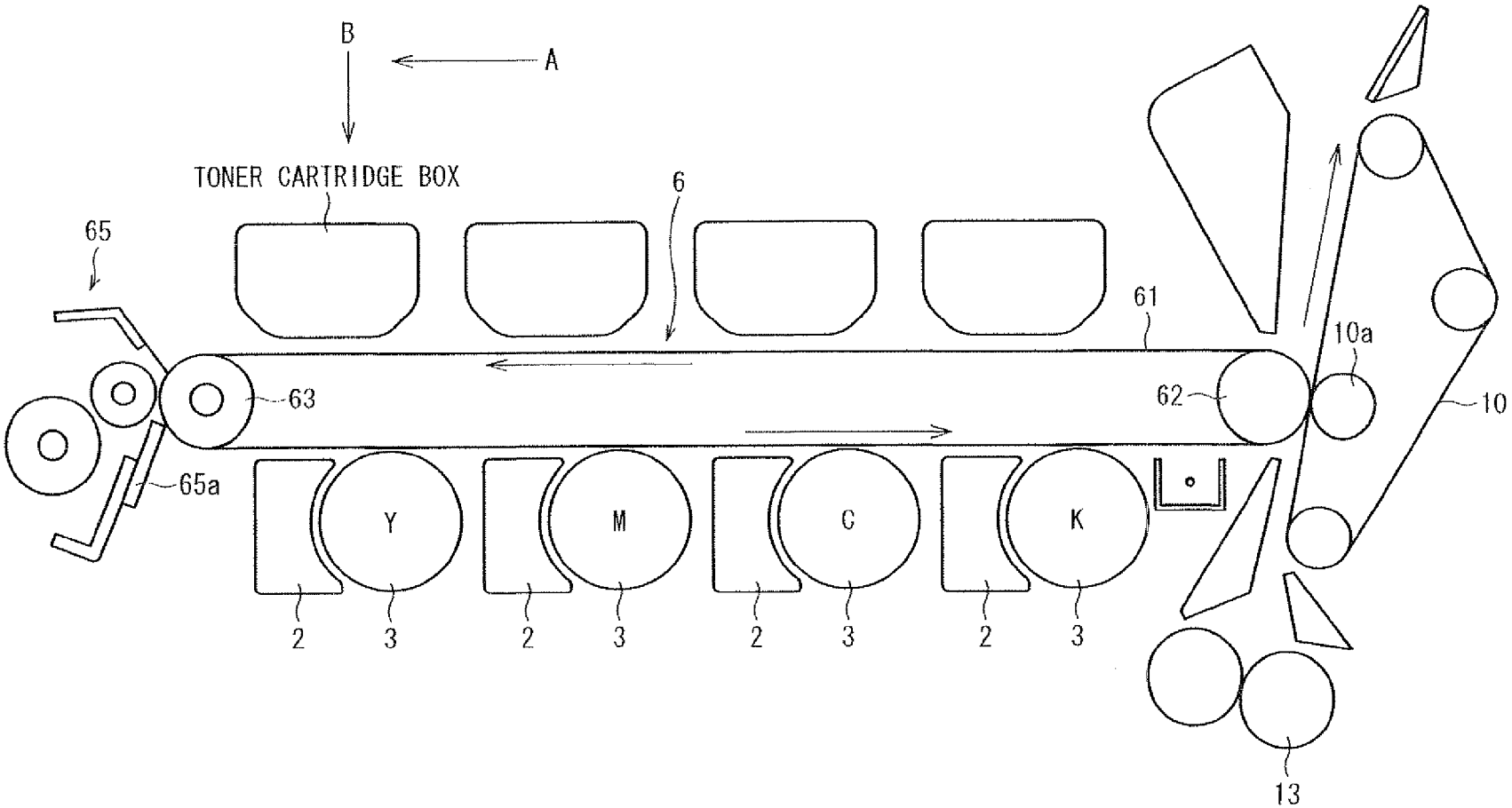
FIG. 2 is an elevation view schematically illustrating the intermediate transfer device illustrated in FIG. 1.
Figure 3:
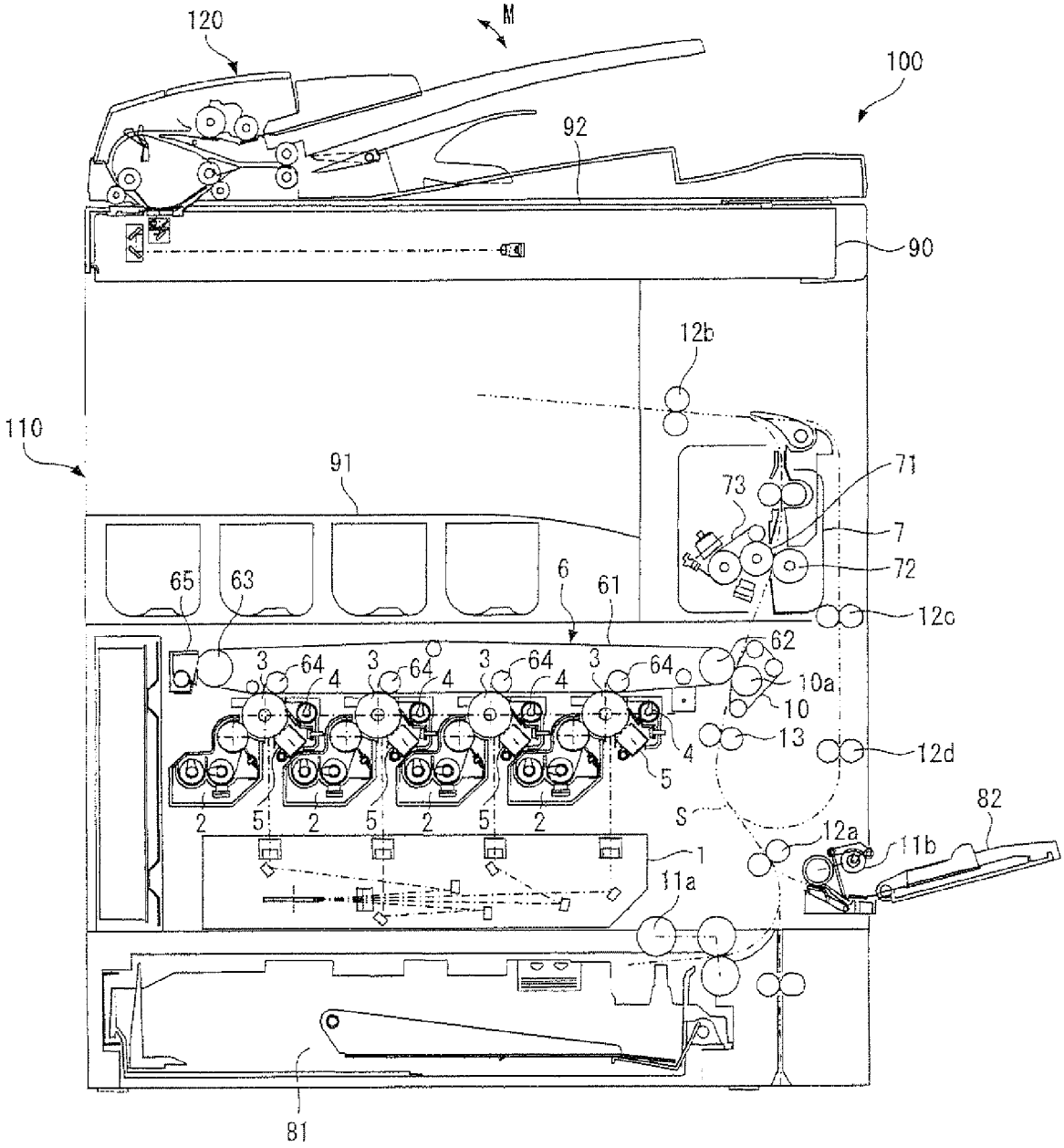
FIG. 3 is a view illustrating an internal arrangement of an image forming apparatus including the intermediate transfer device illustrated in FIGS. 1 and 2.

The following describes an embodiment of the technology, with reference to drawings. FIG. 2 is an elevation view schematically illustrating an intermediate transfer device 6, which is one embodiment of a belt carrying device. FIG. 3 is a view illustrating an internal arrangement of an electrophotographic image forming apparatus 100 including the intermediate transfer device 6 illustrated in FIG. 2.

As illustrated in FIG. 3, the image forming apparatus 100 includes a main body 110 and an automatic document feeder 120. The image forming apparatus 100 forms a multicolor or monochrome image on a predetermined sheet (a recording paper) in accordance with image data that is externally supplied or image data that is read out from a document.

The main body 110 includes an exposure unit 1, developing devices 2, photoreceptor drums 3, cleaner units 4, chargers 5, the intermediate transfer device (an intermediate transfer belt unit) 6, a fixing unit 7, a paper feeding cassette 81, a paper output tray 91, and the like.

A scanner platen 92 made of transparent glass is provided on the top of the main body 110. A document is placed on the scanner platen 92. The automatic document feeder 120 is provided on an upper side of the scanner platen 92. The automatic document feeder 120 automatically feeds documents on the scanner platen 92. The automatic document feeder 120 is rotatably provided in a direction indicated by arrows M. This allows a document to be manually placed on the scanner platen 92, while the automatic document feeder 120 is rotated so that the scanner platen 92 is exposed.

The image forming apparatus 100 deals with sets of image data, which correspond to color components of black (K), cyan (C), magenta (M), and yellow (Y), respectively, so as to form images of the respective color components, i.e., a black image, a cyan image, a magenta image, and a yellow image. Then, the four images are superimposed, thereby forming a multicolor image. As such, the image forming apparatus 100 includes four developing devices 2, four photoreceptor drums 3, four chargers 5, and four cleaner units 4 (see FIG. 3). That is, the image forming apparatus 100 includes four image forming stations (image forming sections) each including a developing device 2, a photoreceptor drum 3, a charger 5, and a cleaner unit 4.

The charger 5 is a charging means for uniformly charging a surface of the photoreceptor drum 3 so that the surface has a predetermined electric potential. As illustrated in FIG. 3, the image forming apparatus 100 employs the charger 5 of an electrostatic charging type. However, the charger 5 is not limited to the electrostatic charging type, but can be a charging roller of a contact-type or a charging brush of a contact-type.

The exposure unit 1 is a laser scanning unit (LSU) including constituents such as a laser emitting section, and a reflection mirror. The exposure unit 1 includes polygon mirrors for performing scanning with a laser beam, and optical components such as lenses and mirrors for directing to the photoreceptor drum 3 the laser beam reflected by the polygon mirror. The exposure unit 1 is not limited to the laser scanning unit, but can be an EL or LED writing head in which light-emitting elements are provided in an array manner.

An exposure unit 1 is provided for forming an electrostatic latent image on a surface of a photoreceptor drum 3. Specifically, the exposure unit 1 carries out an exposure with respect to a photoreceptor drum 3 that is electrically charged, in accordance with image data that is externally supplied or image data that is read out from a document, thereby forming such an electrostatic latent image on the surface of the photoreceptor drum 3. A developing device 2 is provided for visualizing, by use of toner having any color component, the electrostatic latent image formed on a photoreceptor drum 3. A cleaner unit 4 removes and collects toner remaining on a surface of a photoreceptor drum 3 after development and transfer are carried out.

The intermediate transfer device (the belt carrying device) 6 provided above the photoreceptor drums 3 includes an intermediate transfer belt 61, an intermediate transfer belt driving roller 62, an intermediate transfer belt driven roller 63, primary transfer rollers 64, and a intermediate transfer belt cleaning unit 65. The intermediate transfer device 6 includes four primary transfer rollers 64 corresponding to the color components Y, M, C, and K, respectively.

The intermediate transfer belt driving roller (a supporting roller) 62, the intermediate transfer belt driven roller (a supporting roller) 63, and the primary transfer rollers 64 rotate while supporting the intermediate transfer belt (an endless belt) 61. Primary transfer bias voltages are applied via the primary transfer rollers 64 so that toner images on the photoreceptor drums 3 are transferred, respectively, onto the intermediate transfer belt 61.

The intermediate transfer belt 61 is provided so as to be in contact with each of the photoreceptor drums 3. The toner images of the color components, which toner images are formed on the photoreceptor drums, are sequentially transferred onto and superimposed on the intermediate transfer belt 61. This causes a multicolor toner image to be formed on the intermediate transfer belt 61. The intermediate transfer belt 61 is made of a resin film and is endless.

In the present embodiment, the intermediate transfer belt 61 is designed so as to have a thin thickness, thereby realizing a high image quality. More specifically, the intermediate transfer belt 61 is designed so as to have a thickness which falls in a range from 50 μm to 100 μm.

The following explains the reason why a thin intermediate transfer belt 61 allows an improvement in image quality. It appears that the intermediate transfer belt 61 has a property in which an amount of electric charge that can be accumulated within the intermediate transfer belt 61 increases, as the intermediate transfer belt 61 has a smaller thickness. Therefore, it is considered that the intermediate transfer belt 61 has a larger force electrically retaining toner (i.e., a force attracting toner to the intermediate transfer belt 61), as the intermediate transfer belt 61 has a smaller thickness, thereby allowing an improvement in quality of ultimately formed image.

A toner image is transferred from a photoreceptor drum 3 to the intermediate transfer belt 61 by a primary transfer roller 64 that is in contact with a surface on backside of the intermediate transfer belt 61. The primary transfer bias voltages are applied to the primary transfer rollers 64, respectively. Each of the primary transfer bias voltages is a high voltage (a high voltage having a reverse polarity (+) of a charged polarity (−) of the toner).

Each of the primary transfer rollers 64 is a roller made up of a metal (e.g., stainless steel) shaft, serving as a base material, which has a diameter in a range from 8 mm to 10 mm. Each of the primary transfer rollers 64 is covered with an electrically-conductive elastic material such as EPDM, or an urethane foam. The electrically-conductive elastic material makes it possible to uniformly apply a high voltage to the intermediate transfer belt 61. Although a roller-shaped transfer electrode is employed in the present embodiment, the present embodiment is not limited to this. Alternatively, a brush-shaped transfer electrode etc. can be employed.

As described above, electrostatic latent images formed on the photoreceptor drums 3 are visualized and become toner images, respectively, by toner of respective color components. The toner images thus developed are superimposed and stacked on the intermediate transfer belt 61. The toner images thus stacked are moved by the rotation of the intermediate transfer belt 61 to an area where a sheet that has been carried is in contact with the intermediate transfer belt 61 (second transfer position, a predetermined position). Then, the toner images are transferred onto the sheet by a secondary transfer belt 10 that is provided at the second transfer position.

The intermediate transfer belt 61 and the secondary transfer belt 10 are pressed against each other in a predetermined nip area. A secondary transfer bias voltage is applied to the secondary transfer belt 10 so that the toner image is transferred onto the sheet. The secondary transfer bias voltage is a high voltage having the reverse polarity (+) of the charged polarity (−) of the toner.

In order that the predetermined nip area is steadily secured, it is preferable that one of (i) a roller 10*a*, which pressures and is contact with, at the second transfer position, a surface on a backside of the secondary transfer belt 10 and (ii) the intermediate transfer belt driving roller 62, which pressures and is contact with, at the secondary transfer position, a surface on a backside of the intermediate transfer belt 61, is made of a hard material such as metal, whereas the other is made of a soft material (e.g., an elastic rubber roller or a foaming resin roller, or the like) such as an elastic roller.

Toner adhered onto the intermediate transfer belt 61 due to contact with a photoreceptor drum 3, or toner that is not transferred onto a sheet by the secondary transfer belt 10 but remains on the intermediate transfer belt 61 can adversely cause color mixture in a next step. As such, it is so arranged that the cleaning unit 65 removes and collects such toner. The cleaning unit 65 includes a cleaning blade 65*a* (see FIG. 2) as a cleaning member which is in contact with a front surface of the intermediate transfer belt 61. A position where the cleaning blade 65*a* comes in contact with the intermediate transfer belt 61 is supported, from the back side of the intermediate transfer belt 61, by the intermediate transfer belt driven roller 63.

The paper feeding cassette 81 is a tray for storing sheets (recording papers) to be used in image formation, and is provided below the exposure unit 1 in the main body 110. The sheets to be used in image formation can be also placed on a manual paper feeding cassette 82. The paper output tray 91, provided in an upper part of the main body 110, is a tray for stacking printed sheets face down.

The main body 110 includes a sheet carrying path S having a bent shape. The sheet carrying path S is provided for carrying a sheet stored in the paper feeding cassette 81 and a sheet placed on the manual paper feeding cassette 82 to the paper output tray 91, via the secondary transfer position and the fixing unit 7. Pickup rollers 11*a* and 11*b*, carrying rollers 12*a* through 12*d*, registration rollers 13, the secondary transfer belt 10, the fixing unit 7, and other constituents are provided in the vicinity of the sheet carrying path S, which extends from both of the paper feeding cassette 81 and the manual paper feeding cassette 82 to the paper output tray 91.

The carrying rollers 12*a* through 12*d* are small rollers, plurally provided along the sheet carrying path S, for promoting and assisting the carrying of a sheet. The pickup roller 11*a* is provided in the vicinity of an end of the paper feeding cassette 81. The pickup roller 11*a* picks up sheets one by one from the paper feeding cassette 81, and feeds the sheet thus picked up into the sheet carrying path S. Similarly, the pickup roller 11*b* is provided in the vicinity of an end of the manual paper feeding cassette 82. The pickup roller 11*b* picks up sheets one by one from the manual paper feeding cassette 82, and feeds the sheet thus picked up into the sheet carrying path S.

The registration roller 13 is provided for temporarily holding a sheet being carried on the sheet carrying path S. The registration roller 13 has a function of carrying a sheet to the secondary transfer position at a timing when a head of a toner image on the intermediate transfer belt 61 matches a head of a sheet.

The fixing unit 7 includes a heat roller 71 and a pressure roller 72, which rotate while a sheet is sandwiched therebetween. The heat roller 71 is controlled by a controlling section (not illustrated) so as to have a predetermined fixing temperature. The controlling section controls a temperature of the heat roller 71 in accordance with a detection signal supplied by a temperature detector (not illustrated) that detects the temperature of the heat roller 71. The heat roller 71 has a function of thermally fixing onto a sheet a multicolor toner image which has been transferred onto the sheet. Specifically, the heat roller 71 and the pressure roller 72 adhere the toner onto the sheet by the application of heat and pressure. This causes the multicolor toner image which has been transferred onto the sheet to be melted, mixed, and welded with pressure, thereby thermally fixing the multicolor toner image onto the sheet. In the fixing unit 7, an external heat belt 73 is provided that externally heats the heat roller 71.

The following describes a sheet carrying operation to be carried out in the sheet carrying path S. The image forming apparatus 100 includes the paper feeding cassette 81 and the manual paper feeding cassette 82, in each of which sheets are stored in advance. The pickup rollers 11*a* and 11*b* are provided so that sheets are fed, one by one, from the paper feeding cassette 81 and the manual paper feeding cassette 82 to the sheet carrying path S, respectively.

A sheet picked up from the paper feeding cassette 81 or the manual paper feeding cassette 82 is fed by the carrying roller 12*a* to the registration roller 13. Then, the sheet is carried to the secondary transfer position at a timing when a head of the sheet and a head of a toner image on the intermediate transfer belt 61 match with each other. The toner image is then transferred onto the sheet. Then, an unfixed toner image on the sheet is melted and fixed onto the sheet by heat while the sheet passes through the fixing unit 7. Finally, the sheet is discharged to the paper output tray 91 via the carrying roller 12*b*.

The sheet carrying operation described above is carried out in a case where a single-sided printing is requested. In a case where a double-sided printing is requested, the following operation is carried out. Specifically, the carrying roller 12*b* reversely rotates so that a sheet is directed toward the carrying rollers 12*c* and 12*d*, when the carrying roller 12*b*, which a sheet finally reaches in a single-sided printing, holds a rear end of the sheet which passes through the fixing unit 7 after the single-sided printing is completed. Then, a printing is carried out with respect to a backside of the sheet which is carried via the registration roller 13. The sheet that has been subjected to the double-sided printing is finally discharged to the paper output tray 91.

Figure 1:
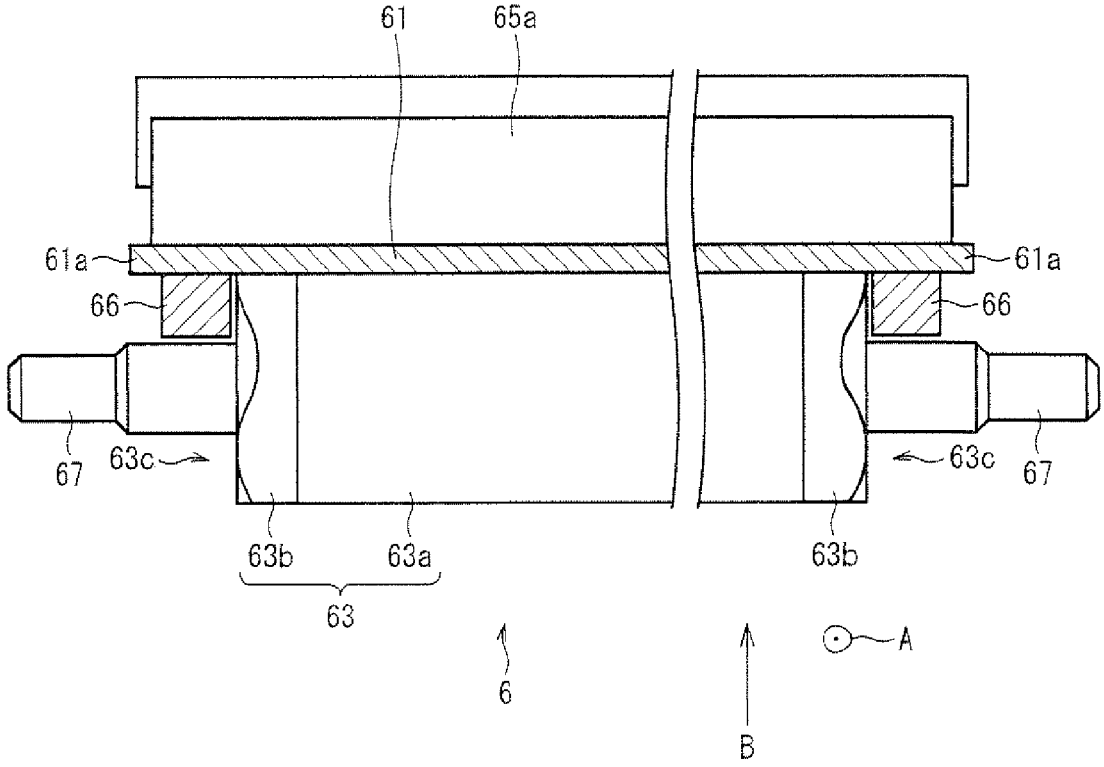
FIG. 1 is a side view schematically illustrating an intermediate transfer device.

The following describes the intermediate transfer device 6 of the present embodiment in more detail. FIG. 1 is a side view schematically illustrating the intermediate transfer device 6. FIG. 1 is a view illustrating how the intermediate transfer device 6 looks like when viewed from a direction opposite to a direction A that is indicated by an arrow in FIG. 2. Assume that a vertical direction (a direction of gravitational force) is a direction B. FIG. 2 illustrates the intermediate transfer device 6 so that the direction B is a lower side of FIG. 2 whereas FIG. 1 illustrates the intermediate transfer device 6 so that the direction B is an upper side of FIG. 1.

As illustrated in FIGS. 1 and 2, the intermediate transfer device 6 includes the intermediate transfer belt driven roller (hereinafter, simply referred to as driving roller) 63, a shaft 67 for rotatably supporting the driven roller 63, and the endless intermediate transfer belt 61 supported by the driven roller 63.

The driven roller 63 includes a roller main body 63*a* and covers (collars) 63*b*. The roller body 63*a* is a cylindrical member made of a hard material such as metal. The covers 63*b* are fitted to both ends of the roller body 63*a* in an axial direction of the roller body 63*a*, respectively. The covers 63*b* are made of POM (Duracon).

The intermediate transfer belt 61 is formed by a resin material having a low shrinkage percentage. PAI (polyamide-imide), PI (polyimide), or PC (polycarbonate) is used as such a resin material having low shrinkage percentage of the intermediate transfer belt 61.

FIG. 1 does not illustrate the intermediate transfer belt driving roller 62. In fact, the intermediate transfer belt driving roller 62 is a roller having substantially the same length as a length of the driven roller 63, and is provided parallel to the driven roller 63 (see FIG. 2).

As illustrated in FIG. 1, the intermediate transfer belt 61 is designed so as to have a width (i.e., a length in the axial direction) longer than the length of the driven roller 63 (i.e., a length of the driven roller 63 in the axial direction of the driven roller 63). As illustrated in FIG. 1, the intermediate transfer belt 61 is positioned so as to project, in the axial direction, from both end surfaces (both bottom surfaces) of the driven roller 63.

Here, parts of the intermediate transfer belt 61, which project, in the axial direction, from the both end surfaces of the driven roller 63, are referred to as projecting areas 61*a*. As illustrated in FIG. 1, meandering suppressing guides 66 are provided on an inner peripheral surfaces of the intermediate transfer belt 61 in the projecting areas 61*a* (guides for suppressing the endless belt from moving to one side of the intermediate transfer belt 61, guiding members) 66, respectively. Each of the meandering suppressing guides 66 is a member that has a rib shape, and that is provided so as to go round along the inner peripheral surface of the intermediate transfer belt 61. The meandering suppressing guides 66 are made of urethane rubber (polyurethane).

According to the arrangement, even in a case where meandering (belt training deviation) is caused in the intermediate transfer device 6, an end surface (a bottom surface, a cover 63*b*) of the driven roller 63 comes into contact with a meandering suppressing guides 66, respectively. This causes the belt training deviation to be suppressed.

In a case of an arrangement in which a meandering suppressing guide 66 made of urethane rubber comes into contact with a roller body 63*a* made of metal, the problem is caused that the roller body 63 scrapes the meandering suppressing guide 66 because of the contact between the meandering suppressing guide 66 and the roller body 63*a*. In view of this, the present embodiment is arranged so that a meandering suppressing guide 66 does not come into contact with the roller body 63*a* made of metal, but comes into contact with a cover 63*b* made of Duracon. This makes it possible to suppress an occurrence of such an undesired situation in which the roller body 63*a* scrapes a meandering suppressing guide 66.

As illustrated in FIGS. 1 and 2, the cleaning blade 65*a* is in contact with the outer peripheral surface of the intermediate transfer belt 61. The cleaning blade 65*a* is provided for cleaning the outer peripheral surface of the intermediate transfer belt 61, by scraping off toner that is not subjected to a secondary transfer onto a sheet but remains on the intermediate transfer belt 61, paper dust, dust, dirt, etc.

Figure 8:
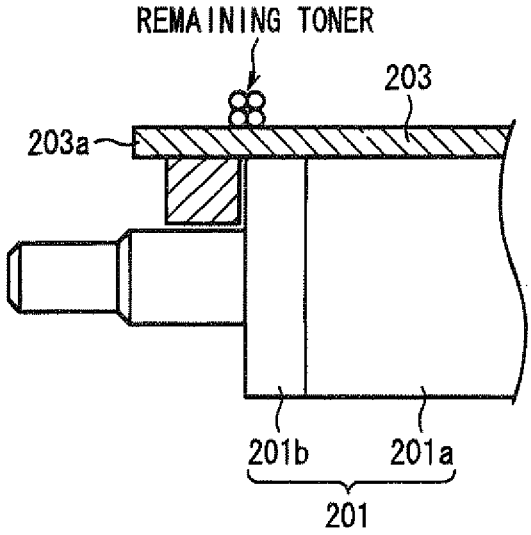
FIG. 8 (PRIOR ART)
FIG. 8 is a view illustrating remaining toner accumulating on an intermediate transfer belt in the conventional intermediate transfer device.
Figure 9:
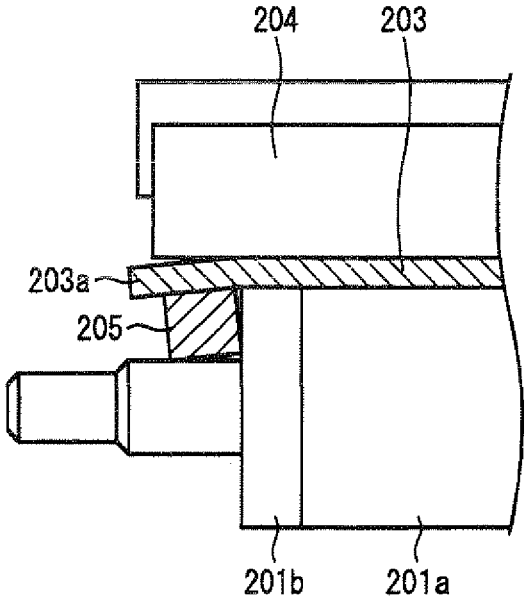
FIG. 9 (PRIOR ART)
FIG. 9 is a view illustrating that a part of the intermediate transfer belt is bent in the conventional intermediate transfer device.

As illustrated in FIG. 9, the projecting areas of the intermediate transfer belt (i.e., parts projecting, in the axial direction of the supporting roller, from both bottom surfaces of the supporting roller) can be easily bent. This causes the projecting areas of the intermediate transfer belt to come off the cleaning blade. As a result, remaining toner on the projecting areas cannot be scraped off by the cleaning blade, but is allowed to pass through the cleaning blade as it is. As such, in a conventional intermediate transfer device, the remaining toner accumulates in one place in the vicinity of each of the projecting areas of the intermediate transfer belt (see FIG. 8). The remaining toner thus accumulated causes an occurrence of a toner stain (inadequate cleaning) linearly extended along the outer peripheral surface of the intermediate transfer belt. In the conventional intermediate transfer device, the remaining toner accumulated on the intermediate transfer belt rubs the same place on the photoreceptor drum for a long period. As such, a local abrasion occurs on the photoreceptor drum. This causes a leakage phenomenon to occur in the place where the local abrasion occurs.

Figure 4:
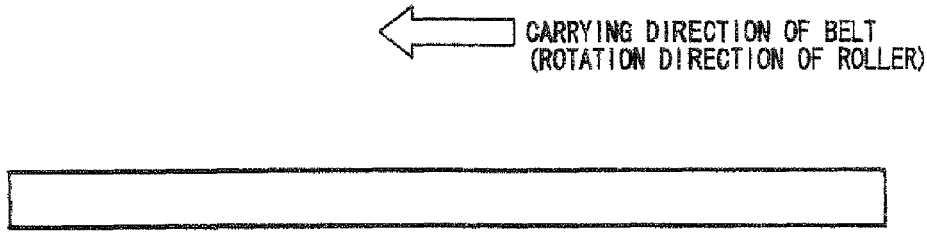
FIG. 4 (a) (PRIOR ART)
FIG. 4(*a*) is a development view illustrating a circumferential surface in the vicinity of one of end surfaces (bottom surfaces) of a supporting roller provided in a conventional intermediate transfer device.
Figure 4:
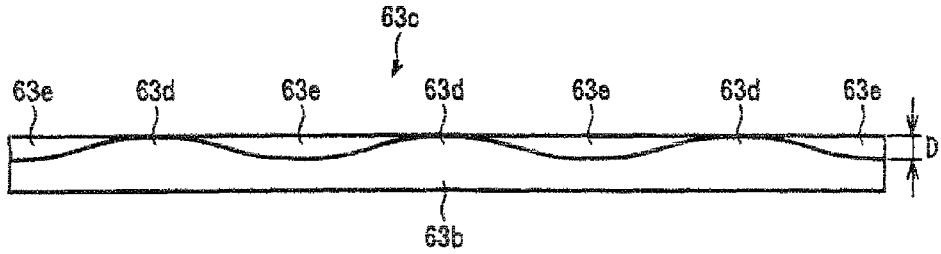
Figure 6:
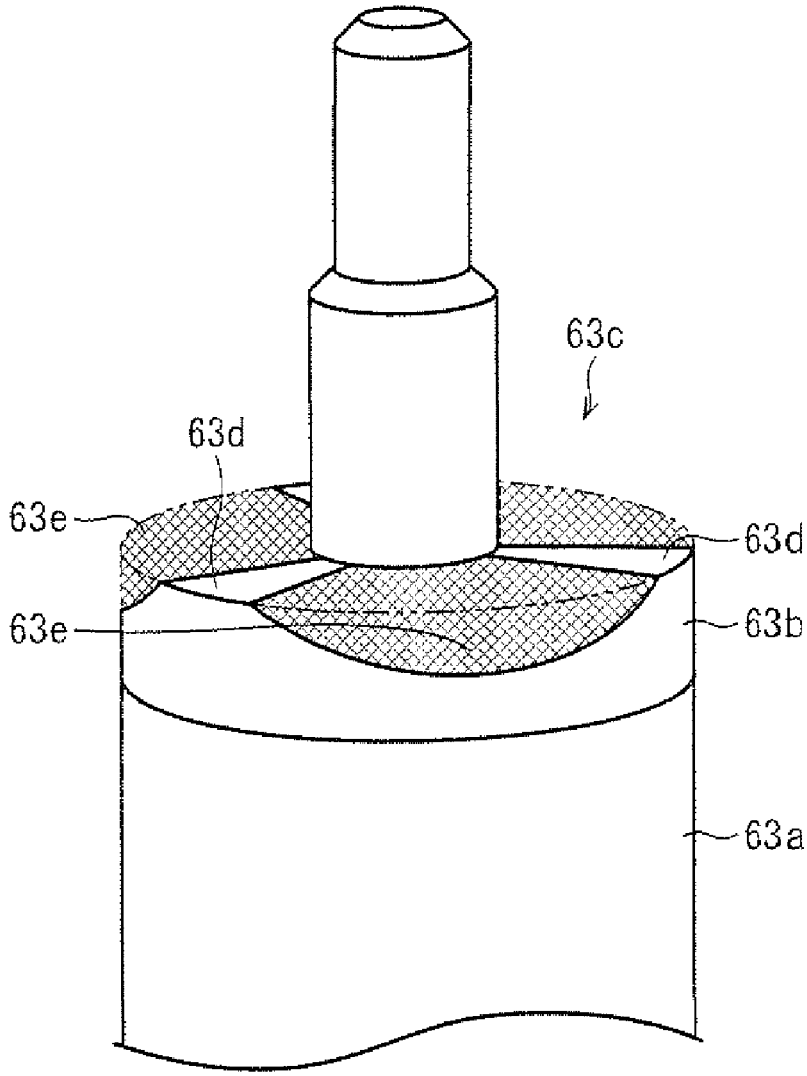
FIG. 6 is a perspective view illustrating the vicinity of one of the end surfaces (the bottom surfaces) of the driven roller provided in the intermediate transfer device.
Figure 7:
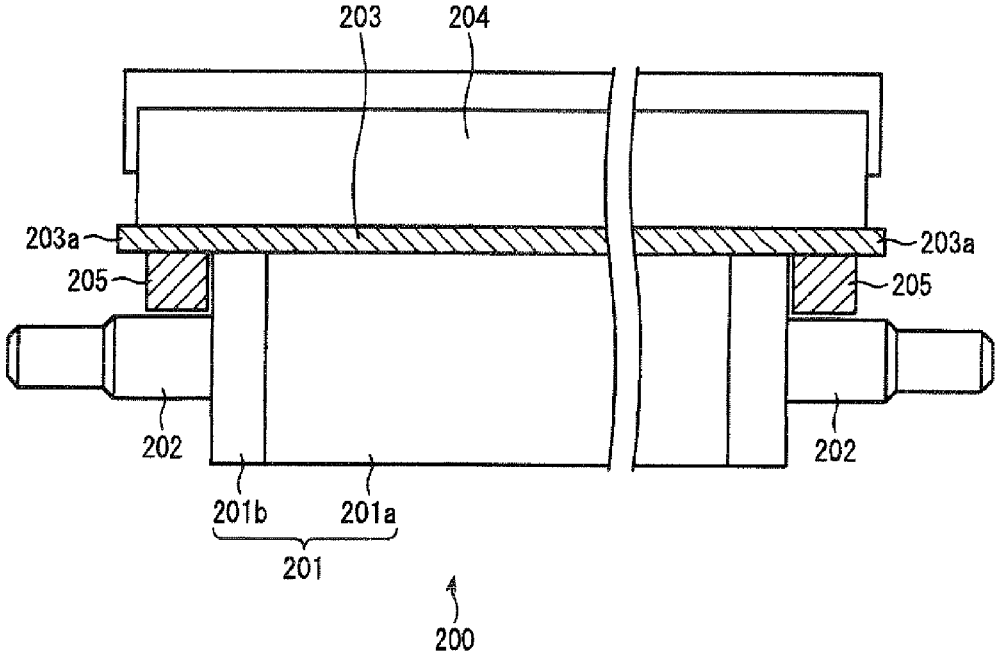
FIG. 7 (PRIOR ART)
FIG. 7 is a view schematically illustrating a conventional intermediate transfer device.

According to the intermediate transfer device 6 of the present embodiment, in contrast, each of both end surfaces 63*c* of the driven roller 63 is arranged so as not to have a plane surface, but to have projecting sections 63*d* and groove sections 63*e*. This suppresses occurrences of the inadequate cleaning and the leakage phenomenon. In FIG. 6, areas where the groove sections 63*e* are provided are indicated by hatching for convenience of explanation. The areas indicated by the hatching are actually cut out, and therefore are grooves. In FIG. 6, for convenience of explanation, each area between a groove section 63*e* and a projecting section 63*d* is indicated by a continuous line indicative of an edge. However, as illustrated in FIG. 1 and FIG. 4(*b*), no edge actually exists. Namely, a curved surface extends between a groove section 63*e* and a projecting section 63*d*.

The following describes in detail (i) a shape of the end surfaces 63*c* of the driven roller 63 and (ii) the reason why the shape of the end surfaces 63*c* can suppress the inadequate cleaning and the leakage phenomenon. As illustrated in FIGS. 1 and 6, the projecting sections 63*d* and the groove sections 63*e* are formed on each of the end surfaces 63*c* of the driven roller 63. The projecting section 63*d* and the groove section 63*e* are alternately provided in a rotation direction of the driven roller 63. The number of the three projecting sections 63*d* is three, and the number of the groove sections 63*e* is three. As illustrated in FIGS. 1 and 6, each of the projecting sections 63*d* has a shape projecting in the axial direction of the driven roller 63, and each of the groove sections 63*e* has a shape depressed in the axial direction of the driven roller 63.

That is, as illustrated in FIG. 4 (*b*), each of the end surfaces 63*c* of the driven roller 63 has a corrugated shape so that a slope is formed repeatedly in the rotation direction of the driven roller 63. In contrast, each of end surfaces of a supporting roller provided in a conventional intermediate transfer device has a flat shape as illustrated in FIG. 4(*a*). FIG. 4(*a*) is a development view illustrating a peripheral surface in the vicinity of an end surface of a supporting roller provided in a conventional intermediate transfer device. FIG. 4(*b*) is a development view illustrating an peripheral surface in the vicinity of an end surface of the driven roller 63 provided in the intermediate transfer device of the present embodiment.

According to the arrangement, the intermediate transfer belt 61 is driven and rotated in response to the rotations of the intermediate transfer belt driving roller 62 and the driven roller 63. This causes the projecting sections 63*d* and the groove sections 63*e*, which are provided on each of the end surfaces 63*c* of the driven roller 63, to go around the rotation axis of the driven roller 63. While an end surface 63*c* of the driven roller 63 comes into contact with a meandering suppressing guide 66, the meandering suppressing guide 66 is shaken by the slope defined by a projecting section 63*d* and a groove section 63*e*. This also shakes a projecting area 61*a*, which is an area of the intermediate transfer belt 61 on which the meandering suppressing guide 66 is provided.

Figure 5:
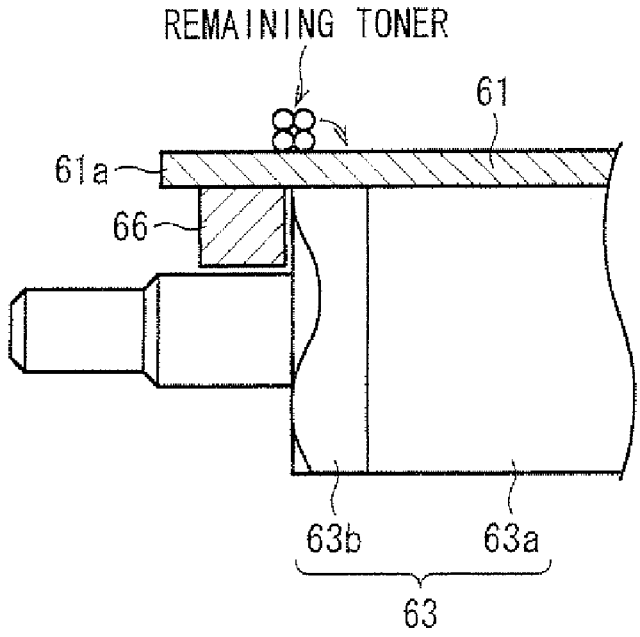
FIG. 5(*a*) is a view illustrating a state before toner on an intermediate transfer belt is moved in the intermediate transfer device.
Figure 5:
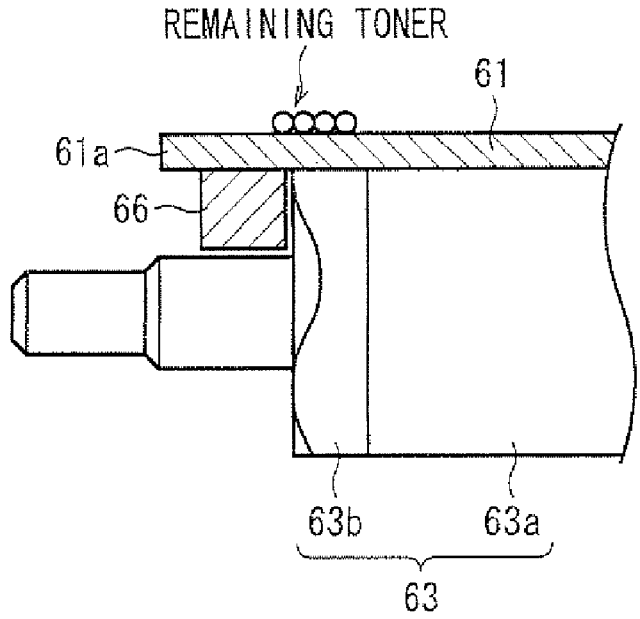

As illustrated in FIG. 5(*a*) and FIG. 5(*b*), while the projecting area 61*a* is shaken, it moves remaining toner adhered onto the outer peripheral surface of the intermediate transfer belt 61 in the projecting area 61*a*. FIG. 5(*a*) is a view illustrating a state in which toner on the intermediate transfer belt 61 has not been moved. FIG. 5(*b*) is a view illustrating a state in which the toner on the intermediate transfer belt 61 has been moved.

As described above, it is possible to move remaining toner adhered onto the outer peripheral surface of the intermediate transfer belt 61 in a projecting area 61 toward an area where the outer peripheral surface of the intermediate transfer belt 61 and the cleaning blade 65*a* maintain making contact with each other, even in a case where a the cleaning blade 65*a* is provided so as to be away from the outer peripheral surface of the intermediate transfer belt 61 in the projecting area 61*a*. This makes it possible to suppress remaining toner from accumulating on the intermediate transfer belt 61, and to thereby suppress inadequate cleaning. This also makes it possible to suppress remaining toner from accumulating on the outer peripheral surface of the intermediate transfer belt 61 in a projecting area 61*a*. As a result, this makes it possible to suppress an occurrence of a leakage phenomenon due to local abrasion caused on the photoreceptor drum 3.

Furthermore, according to the present embodiment, a plurality of projecting sections 63*d* and a plurality of groove sections 63*e* are provided on each of the end surfaces 63*c* of the driven roller 63. The present embodiment is, however, not limited to this. Namely, it is possible to shake a meandering suppressing guide 66 and therefore to move remaining toner, provided that at least one of a projecting section 63*d* and a groove section 63*e* is provided on the end surfaces 63*c* of the driven roller 63.

Note that it is possible to increase the frequency of shaking a meandering suppressing guide 66, in a case where a projecting section 63*d* and a groove section 63*e* for shaking the meandering suppressing guide 66 are alternatively provided in the rotation direction of the driven roller 63, as is the case with the arrangement of the present embodiment. This makes it possible to frequently move remaining toner adhered onto the outer peripheral surface of the intermediate transfer belt 61 in a projecting area 61*a*, and to thereby further suppress the inadequate cleaning. In order to surely move the remaining toner adhered onto the outer peripheral surface of the intermediate transfer belt 61 in a projecting area 61*a* while the meandering of the intermediate transfer belt 61 is suppressed, it is preferable to provide three or more projecting sections 63*d* and three or more groove sections 63*e* so that the meandering suppressing guide 66 is supported by the three or more projecting sections 63*d*.

The present embodiment deals with the case where the intermediate transfer belt 61 is a belt whose primary ingredient is a low shrinkage resin (polyamide-imide resin, polyimide resin, or polycarbonate resin). Employing such a belt as a belt for image transfer makes it possible to improve the quality of an image to be ultimately formed. Note that, in a case where an intermediate transfer belt is employed whose primary ingredient is the low shrinkage resin, a projecting area 61*a* of the intermediate transfer belt 61 can be easily bent. This will cause the cleaning blade 65*a* to be away from the projecting area 61*a*. However, as described above, the projecting sections 63*d* and the groove sections 63*e* are provided on each of the end surfaces 63*c* of the driven roller 63. This makes it possible to suppress the occurrence of the inadequate cleaning and the leakage phenomenon.

In the present embodiment, the intermediate transfer belt 61 is further designed to have a thickness falling in a range from 50 μm to 100 μm, thereby realizing a high image quality. In a case where the thickness of the intermediate transfer belt 61 is 100 μm or less, a projecting area 61*a* of the intermediate transfer belt 61 can be easily bent. This will cause the cleaning blade 65*a* to be away from the projecting area 61*a*. However, as described above, the projecting sections 63*d* and the groove sections 63*e* are provided on each of the end surfaces 63*c* of the driven roller 63. This makes it possible to suppress the occurrence of the inadequate cleaning and the leakage phenomenon.

In an experiment conducted by the inventors, it was found that the inadequate cleaning and the leakage phenomenon could be suppressed in a case where a height distance D is at least 1 mm. The height distance D indicates a difference between a peak of a projecting section 63*d* and a bottom of a groove section 63*e* (see FIG. 4). A preferable range of the height distance D varies depending on type, life, and/or linear pressure of the cleaning blade 65*a*. It should be noted that the height difference indicates a height of the projecting sections 63*d*, and indicates a depth of the groove sections 63*e*. The linear pressure of the cleaning blade 65*a* varies depending on free length, Young's modulus, elastic modulus, and/or thickness of a rubber section of the cleaning blade 65*a*.

In the present embodiment, the cleaning blade 65*a* is employed as a cleaning member for cleaning the outer peripheral surface of the intermediate transfer belt 61. However, alternatively, a cleaning roller or a cleaning brush, which comes in contact with the outer peripheral surface of the intermediate transfer belt 61 can be employed as the cleaning member.

The present embodiment deals with the arrangement in which the projecting sections 63*d* and the groove sections 63*e* are formed on each of the end surfaces 63*c* of the driven roller 63. Alternatively, it can be arranged such that the projecting sections and the groove sections are provided on each of end surfaces of the intermediate transfer belt driving roller 62.

The present embodiment deals with the intermediate transfer device 6 as one example of an embodiment of the belt carrying device. However, the belt carrying device is not limited to the intermediate transfer device 6. For example, the technology is also applicable to (i) a paper carrying device in which a sheet is carried by an endless belt and paper dust on the endless belt is cleaned by a cleaning blade, and (ii) a belt conveyer device for moving toner in which toner is moved by an endless belt and the endless belt is cleaned by a cleaning blade.

The intermediate transfer belt device 6 of the present embodiment can be rephrased as a belt carrying device. A belt carrying device of the present embodiment includes: a plurality of supporting rollers; an endless belt, supported by the plurality of supporting rollers, which is rotated in response to rotations of the plurality of supporting rollers; and guiding members which are provided in projecting areas of the endless belt which project, in an axial direction of the plurality of supporting rollers, from end surfaces of the plurality of supporting rollers, respectively, said guiding members coming into contact with the end surfaces, respectively, so that meandering of the endless belt is suppressed, in said belt carrying device, an outer peripheral surface of the endless belt being cleaned by a cleaning member which is in contact with the outer peripheral surface of the endless belt, at least one of a projecting section and a groove section (i) being provided on end surfaces of at least one of the plurality of supporting rollers, and (ii) rotating around an axis of said at least one of the plurality of supporting rollers in response to rotation of said at least one of the plurality of supporting rollers.

With the arrangement of the present embodiment, while the guiding member is in contact with an end surface of the supporting roller, the guiding member is shaken by slopes and steps of the projecting sections and the groove sections, which are both provided on the end surface. Accordingly, the projecting area of the endless belt where the guiding member is provided is shaken. The shaking of the projecting area moves a cleaning target adhered onto the outer peripheral surface of the endless belt in the projecting area.

Thus, it is possible to move to a position at which the outer peripheral surface of the endless belt and the cleaning member maintain contact with each other the cleaning target adhered onto the outer peripheral surface of the endless belt in the projecting area, even if there is a space between the outer peripheral surface of the endless belt in the projecting area and the cleaning member. This makes it possible to suppress the cleaning target from accumulating at one and the same position on the endless belt, and to thereby suppress inadequate cleaning.

The belt carrying device of the present embodiment is preferably arranged such that a plurality of projecting sections and a plurality of groove sections are provided on the end surfaces of said at least one of the plurality of supporting rollers, the projecting section and the groove section being alternately provided in a direction of rotation of said at least one of the plurality of supporting rollers. According to the arrangement, a projecting section and a groove section for shaking the guiding member are alternatively provided in the rotation direction of the supporting roller. This makes it possible to increase the frequency of shaking the guiding member. Accordingly, a cleaning target adhered onto the outer peripheral surface of the endless belt in a projecting area is frequently moved. As a result, this makes it possible to suppress the inadequate cleaning further.

In order to surely move the remaining toner adhered onto the outer peripheral surface of the endless belt in a projecting area while the meandering of the endless belt is suppressed, it is preferable to provide in the belt carrying device three or more projecting sections and three or more groove sections so that the guiding member is supported by the three or more projecting sections.

In a case where the endless belt is employed whose primary ingredient is the low shrinkage resin such as polyamide-imide resin, polyimide resin, or polycarbonate resin, a projecting area of the endless belt can be easily bent. This will cause the cleaning blade to be away from the projecting area. That is, inadequate cleaning can be easily caused by an arrangement in which the endless belt is made of the low shrinkage resin and none of the groove sections and the projecting sections is provided on an end surface of the supporting roller. According to the arrangement of the present embodiment, in contrast, a plurality of groove sections and a plurality of projecting sections are formed on each of the end surfaces of the supporting roller. This makes it possible to suppress the inadequate cleaning even if the endless belt is employed whose primary ingredient is the low shrinkage resin.

In a case where the endless belt is employed whose primary ingredient is the low shrinkage resin, furthermore, the thinner (i.e., a thickness of 100 μm or less) the endless belt is, the easier the projecting areas of the endless belt are bent and come off the cleaning blade. As such, inadequate cleaning can be easily caused by an arrangement in which the endless belt is employed whose primary ingredient is the low shrinkage resin and has a thickness of 100 μm or less, and none of the groove sections and the projecting sections is formed on each of the end surfaces of the supporting roller. In contrast, according to the present embodiment, the plurality of groove sections and the plurality of projecting sections are formed on each of the end surfaces of the supporting roller. This makes it possible to suppress the inadequate cleaning even if the endless belt is employed whose primary ingredient is the low shrinkage resin and has a thickness of 100 μm or less.

The cleaning member is preferably a cleaning blade that comes in contact with the outer peripheral surface of the endless belt. However, the cleaning member can be a cleaning roller or a cleaning brush, which comes in contact with the outer peripheral surface of the endless belt.

The belt carrying device is applicable to a device such as a paper carrying device. However, as described above, the belt carrying device is preferably applied to an intermediate transfer device provided in an electrophotographic image forming apparatus. In a case where the belt carrying device is applied to an intermediate transfer device, the endless belt is used as an intermediate transfer belt. The intermediate transfer device is a device that (i) temporarily transfers a toner image formed on a photoreceptor onto the intermediate transfer belt, (ii) rotates the intermediate transfer belt so that the toner image transferred onto the intermediate transfer belt is carried to a predetermined position, and (iii) transfers the toner image thus carried onto a sheet at the predetermined position. The below is the reason why the belt carrying device is preferably applied to an intermediate transfer device. In an intermediate transfer device, if a projecting area of the intermediate transfer belt comes off the cleaning blade, remaining toner is accumulated on the outer peripheral surface of the intermediate transfer belt in the projecting area. The remaining toner thus accumulated rubs the same place on the photoreceptor for a long period, thereby causing local abrasion on the photoreceptor. This causes a leakage phenomenon to occur in the place where the local abrasion occurs. According to the present embodiment, in contrast, it is possible to move to a position at which the outer peripheral surface of the intermediate transfer belt and the cleaning blade maintain contact with each other the remaining toner adhered onto the outer peripheral surface of the intermediate transfer belt in the projecting area. This makes it possible to suppress the remaining toner from accumulating on the outer peripheral surface of the intermediate transfer belt in the projecting area, and to thereby suppress the occurrence of the local abrasion and the leakage phenomenon.

The belt carrying device is suitably applicable to a transfer unit provided in an electrophotographic image forming apparatus and to a paper carrying unit.

The technology is not limited to the description of the embodiments above, but may be altered by a skilled person within the scope of the claims. An embodiment based on a proper combination of technical means disclosed in different embodiments is encompassed in the technical scope of the technology.

The embodiments and concrete examples of implementation discussed in the foregoing detailed explanation serve solely to illustrate the technical details, which should not be narrowly interpreted within the limits of such embodiments and concrete examples, but rather may be applied in many variations within the spirit of the technology, provided such variations do not exceed the scope of the patent claims set forth below.

What is claimed is:

1. A belt carrying device comprising:

a plurality of supporting rollers;

an endless belt, supported by the plurality of supporting rollers, which is rotated in response to rotations of the plurality of supporting rollers; and guiding members which are provided in projecting areas of the endless belt which project, in an axial direction of the plurality of supporting rollers, from end surfaces of the plurality of supporting rollers, respectively, said guiding members coming into contact with the end surfaces, respectively, so that meandering of the endless belt is suppressed, in said belt carrying device, an outer peripheral surface of the endless belt being cleaned by a cleaning member which is in contact with the outer peripheral surface of the endless belt, end surfaces of at least one of the plurality of supporting rollers are corrugated such that a projecting section and a groove section are alternately provided in a rotation direction of said at least one of the plurality of rollers, the projecting section and the groove section rotating around an axis of said at least one of the plurality of supporting rollers in response to rotation of said at least one of the plurality of supporting rollers, the guiding members and the projecting areas being shaken by contact of the guiding members with the end surfaces on which the projecting section and the groove section are provided, a cleaning target in the projecting areas being moved by the shaking toward an area where the endless belt and the cleaning member maintain making contact with each other.

2. The belt carrying device as set forth in claim 1, wherein:

the number of the plurality of projecting sections is three or more; and the number of the plurality of groove sections is three or more.

3. The belt carrying device as set forth in claim 1, wherein the endless belt contains, as its primary ingredient, at least one resin selected from the group consisting of a polyamide-imide resin, a polyimide resin, and a polycarbonate resin.

4. The belt carrying device as set forth in claim 3, wherein the endless belt has a thickness of 100 μm or less.

5. The belt carrying device as set forth in claim 1, wherein the cleaning member is a cleaning blade which is in contact with the outer peripheral surface of the endless belt.

6. An intermediate transfer device comprising:

a plurality of supporting rollers;

an intermediate transfer endless belt, supported by the plurality of supporting rollers, which is rotated in response to rotations of the plurality of supporting rollers; and guiding members which are provided in projecting areas of the intermediate transfer belt which project, in an axial direction of the plurality of supporting rollers, from end surfaces of the plurality of supporting rollers, respectively, said guiding members coming into contact with the end surfaces, respectively, so that meandering of the intermediate transfer belt is suppressed, an outer peripheral surface of the intermediate transfer belt being cleaned by a cleaning member which is in contact with the outer peripheral surface of the intermediate transfer belt, in the intermediate transfer device, (i) a toner image formed on a photoreceptor being temporarily transferred onto the intermediate transfer belt, (ii) the intermediate transfer belt being rotated so that the toner image transferred onto the intermediate transfer belt is carried to a predetermined position, and (iii) the toner image thus carried being transferred onto a sheet at the predetermined position, end surfaces of at least one of the plurality of supporting rollers are corrugated such that a projecting section and a groove section are alternately provided in a rotation direction of said at least one of the plurality of supporting rollers, the projecting section and the groove section rotating around an axis of said at least one of the plurality of supporting rollers in response to rotation of said at least one of the plurality of supporting rollers, the guiding members and the projecting areas being shaken by contact of the guiding members with the end surfaces on which the projecting section and the groove section are provided, a cleaning target in the projecting areas being moved by the shaking toward an area where the endless belt and the cleaning member maintain making contact with each other.

7. An image forming apparatus comprising:

a plurality of supporting rollers;

an intermediate transfer endless belt, supported by the plurality of supporting rollers, which is rotated in response to rotations of the plurality of supporting rollers; and guiding members which are provided in projecting areas of the intermediate transfer belt which project, in an axial direction of the plurality of supporting rollers, from end surfaces of the plurality of supporting rollers, respectively, said guiding members coming into contact with the end surfaces, respectively, so that meandering of the intermediate transfer belt is suppressed, an outer peripheral surface of the intermediate transfer belt being cleaned by a cleaning member which is in contact with the outer peripheral surface of the intermediate transfer belt, in the image forming apparatus (i) a toner image formed on a photoreceptor being temporarily transferred onto the intermediate transfer belt, (ii) the intermediate transfer belt being rotated so that the toner image transferred onto the intermediate transfer belt is carried to a predetermined position, and (iii) the toner image thus carried being transferred onto a sheet at the predetermined position, end surfaces of at least one of the plurality of supporting rollers are corrugated such that a projecting section and a groove section are alternately provided in a rotation direction of said at least one of the plurality of supporting rollers, the projecting section and the groove section rotating around an axis of said at least one of the plurality of supporting rollers in response to rotation of said at least one of the plurality of supporting rollers, the guiding members and the projecting areas being shaken by contact of the guiding members with the end surfaces on which the projecting section and the groove section are provided, a cleaning target in the projecting areas being moved by the shaking toward an area where the endless belt and the cleaning member maintain making contact with each other.

* * * * *